US007627469B2

(12) United States Patent
Nettre et al.

(10) Patent No.: US 7,627,469 B2
(45) Date of Patent: Dec. 1, 2009

(54) AUDIO SIGNAL ENCODING APPARATUS AND AUDIO SIGNAL ENCODING METHOD

(75) Inventors: Benjamin Frederic Nettre, Tokyo (JP); Keisuke Toyama, Kanagawa (JP); Shiro Suzuki, Kanagawa (JP)

(73) Assignee: Sony Corporation, Tokyo (JP)

( * ) Notice: Subject to any disclaimer, the term of this patent is extended or adjusted under 35 U.S.C. 154(b) by 951 days.

(21) Appl. No.: 11/132,985

(22) Filed: May 19, 2005

(65) Prior Publication Data

US 2005/0267744 A1 Dec. 1, 2005

(30) Foreign Application Priority Data

May 28, 2004 (JP) ..... P2004-159981

(51) Int. Cl.
*G10L 19/00* (2006.01)

(52) U.S. Cl. ..... 704/220; 704/224; 704/500; 375/243; 375/245

(58) Field of Classification Search ..... 704/220, 704/224, 500; 375/243, 245
See application file for complete search history.

(56) References Cited

U.S. PATENT DOCUMENTS 5,909,467 A * 6/1999 Tae ..... 375/253
5,909,647 A * 6/1999 Hashimoto et al. ..... 455/412.2
2002/0116179 A1* 8/2002 Watanabe ..... 704/200.1
2005/0010396 A1* 1/2005 Chiu et al. ..... 704/200.1
2005/0165611 A1* 7/2005 Mehrotra et al. ..... 704/500

* cited by examiner

*Primary Examiner*—Daniel D Abebe
(74) *Attorney, Agent, or Firm*—Sonnenschein Nath & Rosenthal LLP

(57) ABSTRACT

Any disagreement of the power level before encoding an audio signal and the power level after encoding the audio signal is adjusted to improve the sound quality to the auditory sense. The present invention provides an audio signal encoding apparatus comprising, a band dividing section that divides an input audio signal by a plurality frequency sub-bands, a spectral transform section that transforms the audio signal of each frequency sub-band into a spectral signal, a normalizing section that normalizes each spectral signal by means of a scale factor and generates a normalized spectral signal, a quantizing section that quantizes each normalized spectral signal and generates a quantized spectral signal, a scale factor adjusting section that adjusts the value of the scale factor used by the normalizing section according to the normalized spectral signal and the quantized spectral signal, and an encoding section that encodes at least each quantized spectral signal and the scale factor used by the normalizing section or the scale factor adjusted by the scale factor adjusting section. The scale factor adjusting section is adapted to compare the absolute value of the difference of the energy of the normalized spectral signal and the energy of the quantized spectral signal with a first threshold value for each frequency sub-band and, if the absolute value of the difference is greater than the first threshold value, adjust the value of the scale factor used by the normalizing section so as to make the absolute value of the difference of the energies not greater than a second threshold value.

9 Claims, 7 Drawing Sheets

AUDIO SIGNAL ENCODING APPARATUS AND AUDIO SIGNAL ENCODING METHOD

CROSS REFERENCE TO RELATED APPLICATIONS

The present invention contains subject matter related to Japanese Patent Application JP 2004-159981 filed in the Japanese Patent Office on May 28, 2004, the entire contents of which being incorporated herein by reference.

BACKGROUND OF THE INVENTION

1. Field of the Invention

This invention relates to an audio signal encoding apparatus and an audio signal encoding method for highly efficiently encoding audio signals of voices and music. More particularly, the present invention relates to an acoustic signal encoding apparatus and an acoustic signal encoding method for dividing a spectral signal, which is obtained by transforming an audio signal into a signal of frequency domain, by a plurality of frequency sub-bands and normalizing the signal for each sub-band by means of a scale factor.

2. Description of Related Art

Unblocked frequency division sub-band systems that are typically represented by sub-band coding and blocked frequency division sub-band systems that are typically represented by transform coding are known as techniques for highly efficiently encoding audio signals of voices and music.

With the unblocked frequency division sub-band system, an audio signal of time domain is divided by a plurality sub-bands and encoded for each sub-band without being unblocked. With the blocked frequency division sub-band system, on the other hand, the spectral signals obtained by transforming an audio signal of time domain into a spectral signal of frequency domain (spectral transform) and dividing the latter by a plurality sub-bands, or obtained by spectral transform of the audio signal in short, are grouped and encoded for each predetermined sub-band.

High efficiency encoding techniques of combining the unblocked frequency division sub-band system and the blocked frequency division sub-band system as described above have been proposed to further improve the encoding efficiency. With such a technique, after dividing an audio signal by sub-bands, the audio signal of each sub-band is transformed into a spectral signal of frequency domain by spectral transform and the spectral signals obtained by spectral transform are encoded for each sub-band.

A QMF (Quadrature Mirror Filter) is often used for dividing a frequency band into sub-bands because it provides a simplified process and can cancel aliasing distortions. The division of a frequency band into sub-bands by means of the QMF is described in detail in "R. E. Crochiere, Digital Coding of Speech in Sub bands, Bell Syst. Tech. J., Vol. 55, No. 8, 1976" and some other papers.

The use of a PQF (Polyphase Quadrature Filter) for dividing a frequency band into sub-bands of an equal bandwidth is also known as a technique of producing sub-bands. PQFs are described in "ICASSP 83 BOSTON, Polyphase Quadrature Filters—A new sub-band coding technique, Joseph H. Rothweiler" and some other papers.

On the other hand, there are also known spectral transform techniques of blocking an input audio signal by means of a frame of a predetermined unit time and conducting a Discrete Fourier Transform (DFT) or a Modified Discrete Cosine Transform (MDCT) in order to transform an audio signal of time domain into an audio signal of frequency domain.

The MDCT is described in detail in "ICASSP 1987, Sub-band/Transform Coding Using Filter Bank Designs Based on Time Domain Aliasing Cancellation, J. P. Pincen, A. B. Bradley, Univ. of Surrey Royal Melbourne Inst. of Tech." and some other papers.

Thus, it is possible to control sub-bands where quantization noises arise by quantizing the signal component of each sub-band obtained by means of a filter or spectral transform. Then, it is possible to realize a more efficient coding process in the auditory sense of the words by utilizing the masking effect of such sub-band control. It is also possible to realize a further efficient coding process by normalizing the signal component of each sub-band by means of a scale factor so that the signal component of each sub-band may be found within a predetermined range.

The width of each sub-band that is produced by dividing a frequency band is determined by taking the auditory characteristics of human being. Generally, an audio signal is often divided by a number of bands (e.g., 32 bands) that are referred to as critical bands having widths that vary and of which those of high frequency bands are made large.

When encoding the data of each sub-band, a technique of predetermined bit distribution for each sub-band or a technique of adaptive bit allocation is used to allocate bits to each sub-band. With this technique, when the coefficient data obtained by an MDCT process are encoded by means of bit allocation for example, bits are allocated adaptively to the MDCT coefficient data of each sub-band that are obtained by processing the signal of each block by means of MDCT for the encoding.

Known bit allocation techniques include one that allocates bits according to the size of the signal component of each sub-band (to be referred to as the first bit allocation technique) and one that determines the signal/noise ratio required for each sub-band by utilizing auditory masking and allocates bits in a fixed manner according to the determined ratios (to be referred to as the second bit allocation technique).

The first bit allocation technique is described in detail in, for example, "Adaptive Transform Coding of Speech Signals, R. Zelinski and P. Noll, IEEE Transactions of Acoustics, Speech and Signal Processing, vol. ASSP-25, No. 4, August 1997" and some other papers. The second bit allocation technique is described in detail in, for example, "ICASSP 1980, The critical band coder digital encoding of the perceptual requirements of the auditory system, M. A. Kransner MIT" and some other papers.

The first bit allocation technique provides an advantage of flattening the quantization noise spectrum and minimizing the noise energy but it cannot optimize the feeling of noise to the actual auditory sense because it does not utilize any masking effect. On the other hand, when energy is concentrated to a frequency zone, the characteristic values of bit allocation are not improved significantly by the second bit allocation technique if a sine wave is input because bits are allocated in a fixed manner.

In view of the above identified problems, there has been proposed a high efficiency encoding apparatus that divides all the bits to be used for bit allocation are divided into a quota for a fixed bit allocation pattern by which bits are allocated to small blocks in a predetermined manner and a quota for allocating bits depending on the size of the signal of each block, the ratio of the two quotas being dependent on a signal related to the input signal. For example, the smoother the spectrum of the signal, the larger is the quota for the fixed bit allocation pattern.

With the technique used in the high efficiency encoding apparatus, when energy is concentrated to a specific spectrum as in the case of an input of a sine wave, a large number of bits are allocated to the block that contains the spectrum so that it is possible to dramatically improve the overall signal/noise ratio. Since the auditory sense of human being is very sensitive to a signal having a sharp spectrum component, the above described apparatus that can improve the signal to noise characteristics in the above described manner operates effectively to improve not only the numerical value of the observed signal/noise ratio but also the sound quality perceived by the auditory sense.

Many other bit allocation techniques have been proposed to date. Thus, it will be possible to realize high efficiency encoding from the auditory point of view when more sophisticated auditory models are developed and the capabilities of encoders are improved.

When DFT or DCT is used as a technique of transforming an audio signal of time domain into a spectral signal of frequency domain and a time block containing M samples is used for the transform, M independent real data are obtained. However, since each block is normally arranged in such a way that a predetermined number of samples, or M1 samples, are contained in the overlapping area of the block and each of the adjacently located side blocks in order to alleviate the strain of connection, M real data are quantized and encoded for (M-M1) samples in average with an encoding technique of using DFT or DCT.

Additionally, when MDCT is used as a technique of transforming an audio signal into a spectral signal, M independent real data are obtained from 2M samples in the overlapping areas of each block overlapping with the adjacently located side blocks, each of which overlapping areas contains M samples. Therefore, M real data are quantized and encoded for M samples in average. In this case, the decoder reconfigures the audio signal by conducting an inverse transform of the codes that are obtained by MDCT in each block and adding the waveform elements obtained by the inverse transform, causing them interfere with each other.

Generally, frequency resolution of a spectral signal is improved by elongating the time block (frame) for transform and energy is concentrated to a specific spectral coefficient. Therefore, it is possible to realize a highly efficient encoding process by employing an MDCT technique of using blocks having a large block length and overlapping with each of the adjacently located side blocks by a half thereof with the number of spectral coefficients not increased relative to the number of samples in the original time domain if compared with the use of DFT or DCT. Additionally, it is possible to alleviate the inter-block strain of an audio signal by making adjacently located blocks overlap with each other by a sufficiently large length.

When actually configuring a string of codes, firstly, quantization accuracy information that indicates the quantization step and the scale factor used for normalizing each signal component are firstly encoded with a predetermined number of bits for each sub-band that is used for normalization and quantization and subsequently, the quantized coefficient that is normalized and quantized is encoded.

FIG. 1 is a schematic illustration of the configuration a known audio signal encoding apparatus for dividing an audio signal by frequency sub-bands and encoding the audio signal. Referring to FIG. 1, the audio signal encoding apparatus 100 comprises a band dividing section 110 that inputs an audio signal to be encoded and divides it into four audio signals of four sub-bands, for example, by means of a filter such as a QMF or a PQF. The sub-bands may have the same and uniform bandwidth or uneven respective bandwidths that match critical bands. While the input audio signal is divided into four audio signals of four sub-bands in the illustrated known apparatus, the number of sub-bands is not limited to four. The band dividing section 110 supplies the four audio signals of the four sub-bands (which may be referred to "the first through fourth sub-bands" hereinafter if appropriate) obtained by the division to the respective spectral transform sections $\mathbf{111}_1$ through $\mathbf{111}_4$ on the basis of a predetermined time block (frame).

The spectral transform sections $\mathbf{111}_1$ through $\mathbf{111}_4$ conduct a process of spectral transform such as MDCT on the respective audio signals of time domain of the sub-bands to generate spectral signals of frequency domain and supply the spectral signals respectively to normalizing sections $\mathbf{112}_1$ through $\mathbf{112}_4$ and then to quantization accuracy determining section 113.

The normalizing sections $\mathbf{112}_1$ through $\mathbf{112}_4$ select an optimum scale factor according to the spectral signals of the first through four sub-bands out of a plurality scale factors that are defined in advance. At this time, each of the normalizing sections $\mathbf{112}_1$ through $\mathbf{112}_4$ selects a scale factor that makes the corresponding normalized spectral signal to be contained within a predetermined range and maintains it accuracy but fully extends within the entire range. Then, the normalizing sections $\mathbf{112}_1$ through $\mathbf{112}_4$ respectively normalize (divide) the spectral coefficients of the spectral signals of the first through fourth sub-bands by the scale factors selected respectively for the first through fourth sub-bands. Then, the normalizing sections $\mathbf{112}_1$ through $\mathbf{112}_4$ supply the normalized spectral signals of the first through fourth sub-bands respectively to quantizing sections $\mathbf{114}_1$ through $\mathbf{114}_4$ and the scale factors of the first through fourth sub-bands to a multiplexer 115.

A quantization accuracy determining section 113 defines the quantization step for quantizing the normalized spectral signals of the first through fourth sub-bands according to the spectral signals of the first through fourth sub-bands supplied from the spectral transform sections $\mathbf{111}_1$ through $\mathbf{111}_4$. Then, the quantization accuracy determining section 113 supplies the quantization accuracy information of the first through fourth sub-bands respectively to the quantizing sections and also to the multiplexer 115.

The quantizing sections $\mathbf{114}_1$ through $\mathbf{114}_4$ quantize the normalized spectral signals of the first through fourth sub-bands in the quantization step that corresponds to the quantization accuracy information of the first through fourth sub-bands and supply the quantized spectral signals of the first through fourth sub-bands obtained in the quantization step to the multiplexer 115.

The multiplexer 115 encodes the quantized spectral signals of the first through fourth sub-bands, the quantization accuracy information and the scale factors typically by Huffman coding and subsequently multiplexes them. Then, the multiplexer 115 transmits the coded bit stream obtained as a result of the multiplexing by way of a transmission path and record it on a recording medium (not shown).

SUMMARY OF THE INVENTION

Meanwhile, when a high compression ratio is required, the number of bits assigned to one or more than one sub-bands that are not important from the auditory point of view, particularly those of a high frequency range, can be reduced at the encoding side. Additionally, the value of each of some of the spectral coefficients can be replaced by 0 or some other small value in a sub-band for the purpose of accurately encoding the spectral coefficients that are more important from the auditory point of view (see, inter alia, Japanese Patent Application Laid-Open Publication No. 9-214355). Then, as a result, the audio signal of a sub-band whose number of assigned bits is reduced can show a disagreement of power before and after the encoding. Such an audio signal can be a problem from the auditory point of view.

FIG. 2 shows a spectral signal obtained by dividing an audio signal with a frequency band width of 22 kHz into four audio signals of four sub-bands including sub-band 0 (0-5.5 kHz), sub-band 1 (5.5-11 kHz), sub-band 2 (11-16.5 kHz) and sub-band 3 (16.5-22 kHz) and conducting a spectral transmission of MDCT and the average energy E (dB) of the spectral coefficients of each sub-band. FIG. 3 shows a spectral signal obtained by decoding the encoded audio signal and the average energy F (dB) of the spectral coefficients of each sub-band. It will be seen by comparing FIGS. 2 and 3, that the average energy F is remarkably reduced from the original average energy E particularly in the sub-band 2 and the sub-band 3. Such a phenomenon will be perceived as lack of power when the audio signal is reproduced.

In view of the above-identified circumstances, it is desirable to provide an audio signal encoding apparatus and an audio signal encoding method that can correct the disagreement before and after the encoding of an audio signal and improve the sound quality of the audio signal to the auditory sense.

According to the present invention, there is provided an audio signal encoding apparatus comprising: a band dividing means for dividing an input audio signal by a plurality frequency sub-bands; a spectral transform means for transforming the audio signal of each frequency sub-band into a spectral signal; a normalizing means for normalizing each spectral signal by means of a scale factor and generating a normalized spectral signal; a quantizing means for quantizing each normalized spectral signal and generating a quantized spectral signal; a scale factor adjusting means for adjusting the value of the scale factor used by the normalizing means according to the normalized spectral signal and the quantized spectral signal; and an encoding means for encoding at least each quantized spectral signal and the scale factor used by the normalizing means or the scale factor adjusted by the scale factor adjusting means; the scale factor adjusting means being adapted to compare the absolute value of the difference of the energy of the normalized spectral signal and the energy of the quantized spectral signal with a first threshold value for each frequency sub-band and, if the absolute value of the difference is greater than the first threshold value, adjust the value of the scale factor used by the normalizing means so as to make the absolute value of the difference of the energies not greater than a second threshold value.

Preferably, the scale factor adjusting means decides if it adjusts the scale factor or not according to the tonality of the normalizing spectral signal in each frequency sub-band or the tonality of the normalized spectral signal in each frequency sub-band and the tonality of the quantized spectral signal in each frequency sub-band. Preferably, the scale factor adjusting means defines the second threshold value according to the tonality of the normalized spectral signal in each frequency sub-band and the tonality of the quantized spectral signal in each frequency sub-band.

According to the present invention, there is provided an audio signal encoding method comprising: a band dividing step of dividing an input audio signal by a plurality frequency sub-bands; a spectral transform step of transforming the audio signal of each frequency sub-band into a spectral signal; a normalizing step of normalizing each spectral signal by means of a scale factor and generating a normalized spectral signal; a quantizing step of quantizing each normalized spectral signal and generating a quantized spectral signal; a scale factor adjusting step of adjusting the value of the scale factor used in the normalizing step according to the normalized spectral-signal and the quantized spectral signal; and an encoding step of encoding at least each quantized spectral signal and the scale factor used in the normalizing step or the scale factor adjusted in the scale factor adjusting step; the scale factor adjusting step being adapted to compare the absolute value of the difference of the energy of the normalized spectral signal and the energy of the quantized spectral signal with a first threshold value for each frequency sub-band and, if the absolute value of the difference is greater than the first threshold value, adjust the value of the scale factor used by the normalizing step so as to make the absolute value of the difference of the energies not greater than a second threshold value.

Thus, with an audio signal encoding apparatus and an audio signal encoding method according to the invention, the energy of a normalized spectral signal in each frequency sub-band is compared with the energy of a corresponding quantized spectral signal in each frequency sub-band and if they do not agree with each other in a frequency sub-band, it is possible to correct the disagreement of the two energies by adjusting the scale factor the frequency sub-band in question. Thus, it is possible to prevent any auditory problem from arising when the audio signal is reproduced.

DETAILED DESCRIPTION OF THE PREFERRED EMBODIMENTS

Now, a preferred embodiment of the present invention will be described in greater detail by referring to the accompanying drawings. This embodiment is an audio signal encoding apparatus adapted to transform an audio signal into a spectral signal of frequency domain, divide the spectral signal by a plurality of sub-bands, normalize the spectral-signal by means of a scale factor in each sub-band and encode the spectral signal by way of bit allocation.

In this audio signal encoding apparatus, the average energy of the spectral coefficients of each sub-band of a normalized spectral signal after normalization and before quantization is compared with the average energy of the spectral coefficients of each sub-band of the quantized spectral signal obtained as a result of quantization and, if they do not agree with each other and the energy of a sub-band is reduced after quantization, the scale factor of the sub-band is adjusted. Now, the configuration of the audio signal encoding apparatus will be described first and subsequently the part of the audio signal encoding apparatus that represents the present invention will be described.

Figure 4:
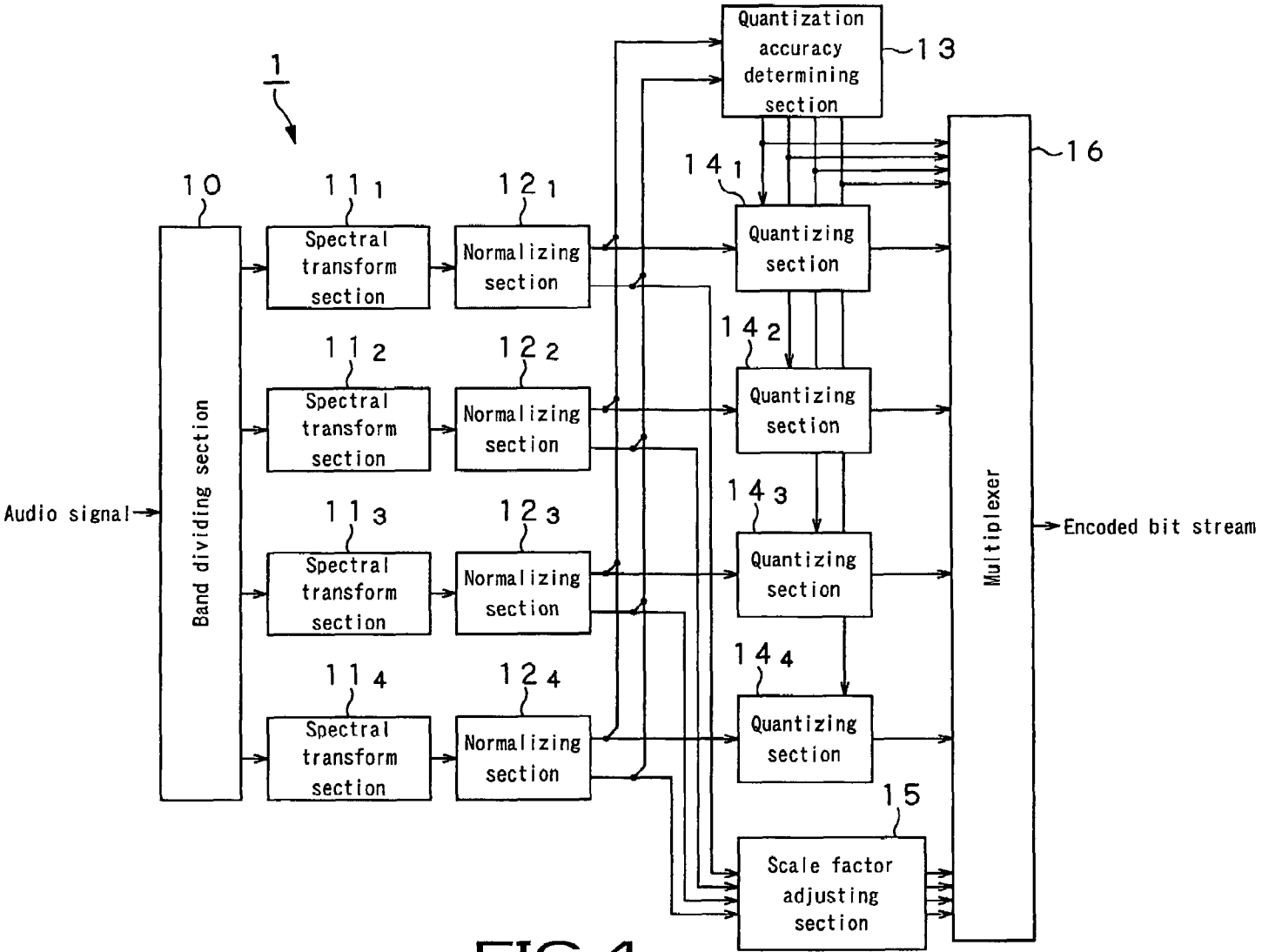
FIG. 4 is a schematic block diagram of an embodiment of audio signal encoding apparatus according to the invention.

FIG. 4 is a schematic block diagram of the embodiment of audio signal encoding apparatus according to the embodiment. Referring to FIG. 4, the audio signal encoding apparatus 1 comprises a band dividing section 10 that inputs an audio signal to be encoded and divides it typically into four audio signals of four sub-bands by means of a filter such as a QMF (Quadrature Mirror Filter) or a PQF (Polyphase Quadrature Filter). The sub-bands may have a same and uniform bandwidth or uneven respective bandwidths that match critical bands. While an audio signal is divided into four sub-band audio signals in this embodiment, the number of sub-bands is not limited to four. The band dividing section 10 supplies the audio signals of the four sub-bands (which may be referred to "the first through fourth sub-bands" hereinafter if appropriate) obtained by the division to the respective-spectral transform sections $\mathbf{11}_1$ through $\mathbf{11}_4$ on the basis of a predetermined time block (frame).

The spectral transform sections $\mathbf{11}_1$ through $\mathbf{11}_4$ conduct a process of spectral transform such as MDCT on the respective audio signals of time domain of the sub-bands to generate spectral signals of frequency domain and supply the spectral signals respectively to normalizing sections $\mathbf{12}_1$ through $\mathbf{12}_4$, to quantization accuracy determining section 13 and then to a scale factor adjusting section 15.

The normalizing sections $\mathbf{12}_1$ through $\mathbf{12}_4$ select an optimum scale factor according to the spectral signals of the first through four sub-bands out of a plurality scale factors that are defined in advance. At this time, each of the normalizing sections $\mathbf{12}_1$ through $\mathbf{12}_4$ selects a scale factor that makes the corresponding normalized spectral signal to be contained within a predetermined range and maintains it accuracy but fully extends within the entire range. Then, the normalizing sections $\mathbf{12}_1$ through $\mathbf{12}_4$ respectively normalize (divide) the spectral coefficients of the spectral signals of the first through fourth sub-bands by the scale factors selected respectively for the first through fourth sub-bands. Then, the normalizing sections $\mathbf{12}_1$ through $\mathbf{12}_4$ supply the normalized spectral signals of the first through fourth sub-bands respectively to quantizing sections $\mathbf{14}_1$ through $\mathbf{14}_4$ and the scale factors of the first through fourth sub-bands to the scale factor adjusting section 15.

The quantization accuracy determining section 13 defines the quantization step for quantizing the normalized spectral signals of the first through fourth sub-bands according to the spectral signals of the first through fourth sub-bands supplied from the spectral transform sections $\mathbf{11}_1$ through $\mathbf{11}_4$. Then, the quantization accuracy determining section 13 supplies the quantization accuracy information of the first through fourth sub-bands corresponding to the quantization step respectively to the quantizing sections $\mathbf{14}_1$ through $\mathbf{14}_4$ and also to the multiplexer 16.

The quantizing sections $\mathbf{14}_1$ through $\mathbf{14}_4$ quantize the normalized spectral signals of the first through fourth sub-bands in the quantization step that corresponds to the quantization accuracy information of the first through fourth sub-bands and supply the quantized spectral signals of the first through fourth sub-bands obtained in the quantization step to the scale factor adjusting section 15 and the multiplexer 16.

The scale factor adjusting section 15 compares the average energy of the spectral coefficients of the first through fourth sub-bands supplied from the spectral transmission sections $\mathbf{11}_1$ through $\mathbf{11}_4$ and the average energy of the spectral coefficients of the first through fourth sub-bands supplied from the quantizing sections $\mathbf{14}_1$ through $\mathbf{14}_4$. If the absolute value of the difference is smaller than the threshold, the scale factor adjusting section 15 supplies the scale factors supplied from the normalizing sections $\mathbf{12}_1$ through $\mathbf{12}_4$ to the multiplexer 16 without modification. If, on the other hand, the absolute value of the difference is not smaller than the threshold value and the average energy of a sub-band is reduced after the quantization, the scale factor adjusting section 15 adjusts the scale factor of the sub-band so as to make the average energy of the sub-band come close to the average energy before the quantization before it supplies the scale factors to the multiplexer 16. The scale factor adjusting section 15 changes the extent of adjustment of scale factor according to the position of the sub-band and the local spectral features (such as tonality), which will be described in greater detail hereinafter.

The multiplexer 16 encodes the quantized spectral signals of the first through fourth sub-bands, the quantization accuracy information and the scale factors typically by Huffman coding and subsequently multiplexes them. Then, the multiplexer 16 transmits the coded bit stream obtained as a result of the multiplexing by way of a transmission path and record it on a recording medium (not shown).

Figure 5:
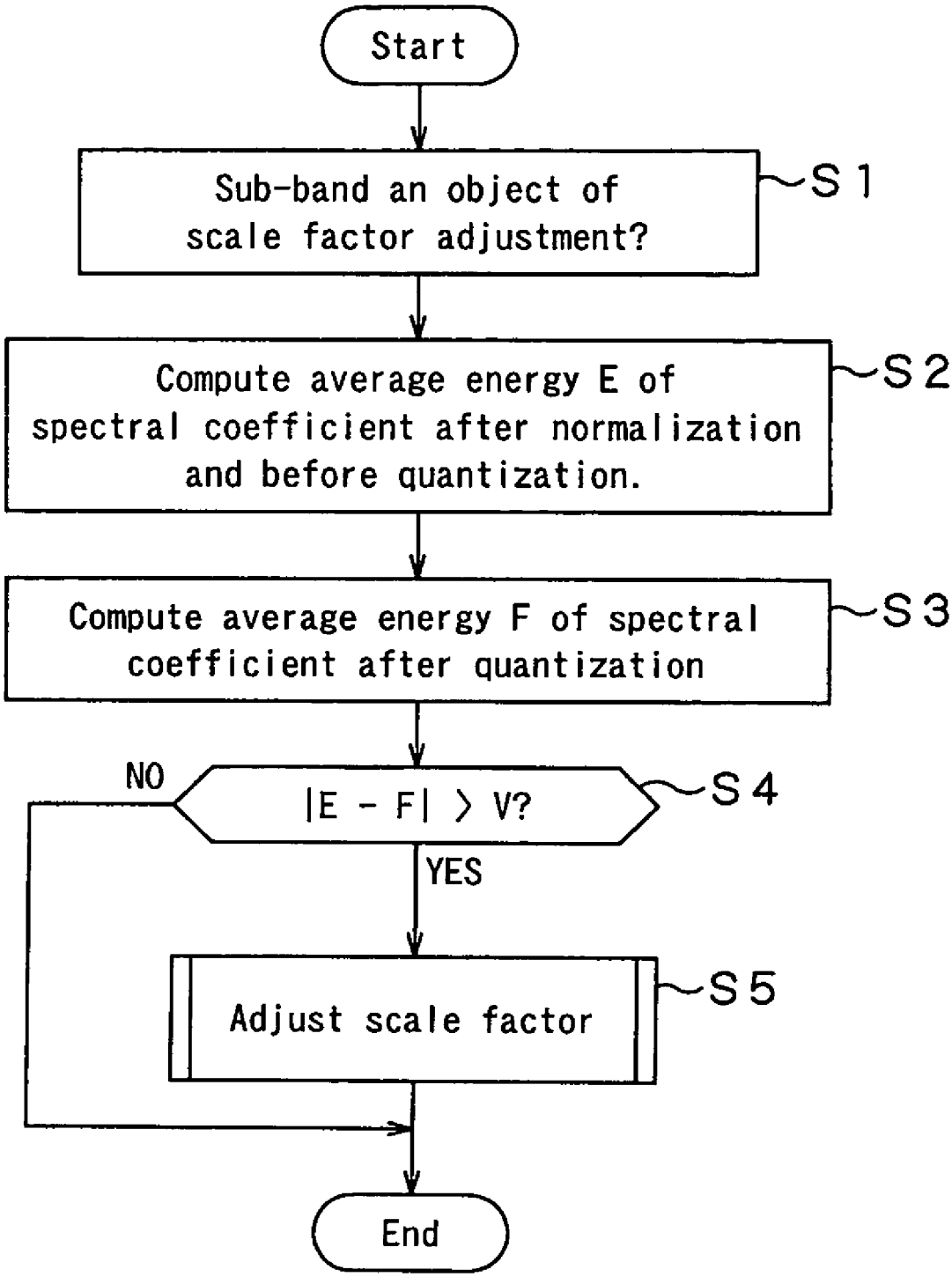
FIG. 5 is flow chart of the process of modifying a scale factor in the embodiment of audio signal encoding apparatus of FIG. 4.

Now, the process of adjusting any of the scale factors of the scale factor adjusting section 15 will be described by referring to the flow chart of FIG. 5.

Firstly, in Step S1, the scale factor adjusting section 15 determines if the sub-band that is being currently processed is an object of scale factor adjustment or not. More specifically, it determines if the current sub-band is not below a predetermined boundary frequency or not and proceeds to Step S2 if the current sub-band is not below the predetermined boundary frequency (Yes). If, on the other hand, the current sub-band is below the boundary frequency (No), the scale factor adjusting section 15 does not adjust the scale factor and ends the process. This is because the auditory influence of adjusting the scale factor for agreement of power levels is greater than that of the change in the wavelength of the spectral signal produced by the adjustment in a sub-band of a low frequency range but opposite in a sub-band of a high frequency range. It is preferable to define the boundary frequency for determining if a scale factor is to be adjusted or not according to the bit rate. For example, a quantized spectral signal obtained by quantization is not intrinsically very accurate if the bit rate is low so that sub-bands of a low frequency range may be selected as objects of scale factor adjustment.

Then, the average energy E of the spectral coefficients of the sub-band after normalization and before quantization is computed in Step S2 and the average energy F of the spectral coefficients after quantization is computed in Step S3.

Subsequently, it is determined if the absolute value of the difference $|E-F|$ between the average energy E and the average energy F is greater than a predetermined threshold value V or not, in Step S4. The threshold value V may be made equal to the amount of energy (e.g., 2 dB) by which the scale factor is raised or lowered by a step in a plurality of steps predefined for the scale factor. The process is terminated if the absolute value of the difference $|E-F|$ is not greater than the threshold value V (No) because the two energies cannot be brought closer to each other by adjusting the scale factor. The scale factor adjusting section 15 proceeds to Step S5 and executes a process of adjusting the scale factor if the absolute value of the difference |E−F| is greater than the threshold value V (Yes).

Figure 6:
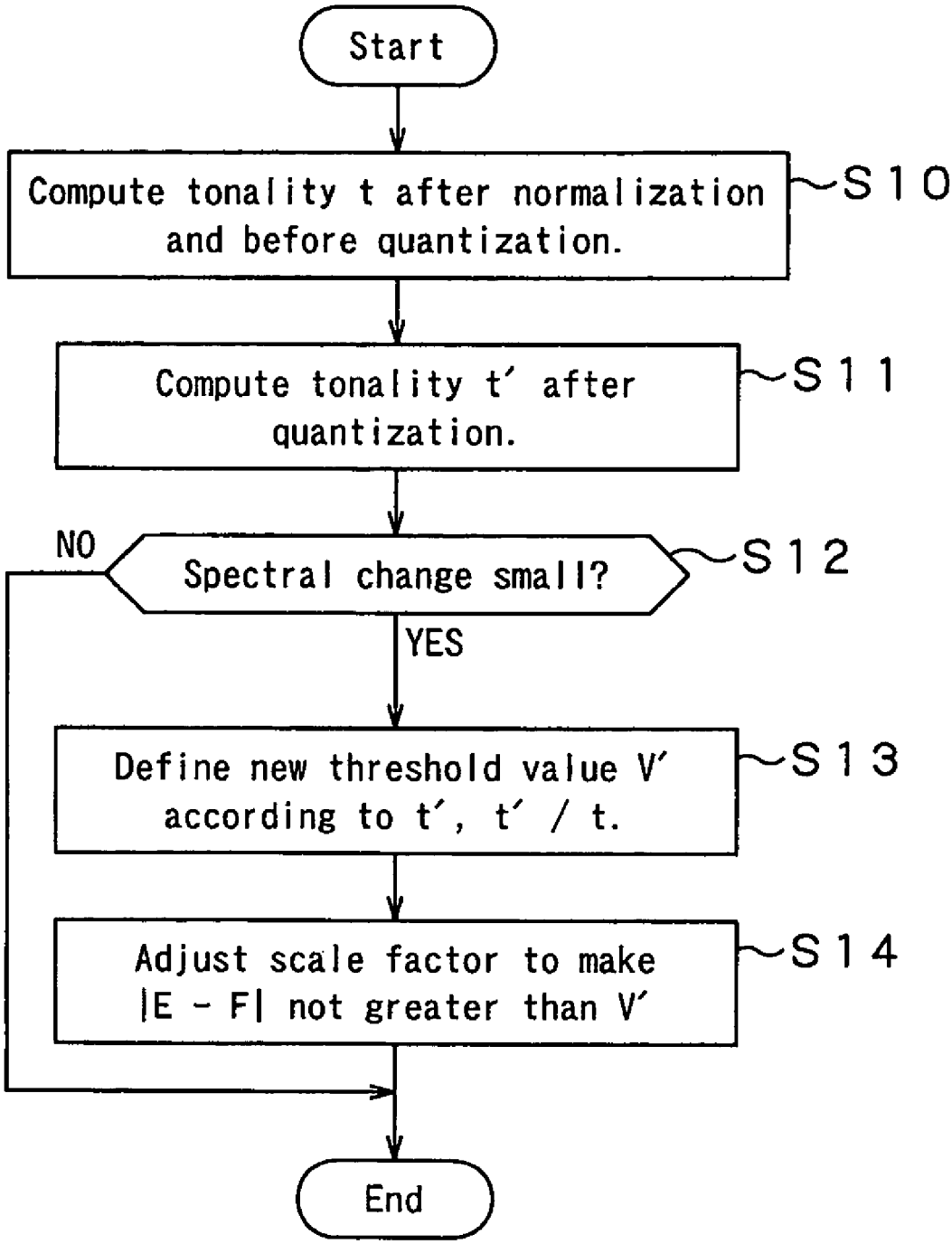
FIG. 6 is another flow chart of the process of modifying a scale factor in the embodiment of audio signal encoding apparatus of FIG. 4.

Now, the process of adjusting the scale factor in Step S5 will be described further by referring to the flow chart of FIG. 6.

Firstly, in Step S10, the scale factor adjusting section 15 computes the tonality t of the sub-band after normalization and before quantization and then, in Step S11, it computes the tonality t' of the sub-band after quantization. If there are n spectral coefficients Xi (i=1, 2, . . . , n) in the sub-band, the tonality t can be computationally determined by using formula (1) shown below.

[formula 1] (1)

$$t = \frac{n \times \mathrm{Max}|Xi|}{\sum_{i=1}^{n} |Xi|}$$

Thereafter, in Step S12, the scale factor adjusting section 15 judges if the spectral change that arises due to quantization and bit allocation is sufficiently small or not for adjusting the scale factor on the basis of a psychological model by referring to the tonality t and the ratio of the tonality t to the tonality t', or t/t'. It is preferable not to adjust the scale factor if the sub-band contains higher harmonics and the tonality t is high. On the other hand, it is preferable to adjust the scale factor in order to dissolve the disagreement of the energies if the tonality t is close to 1 because of noisiness. The scale factor adjusting section 15 ends the process in Step S12 if the spectral change is large (No) but it proceeds to Step S13 if the spectral change is small (Yes).

Then, in Step S13, the scale factor adjusting section 15 defines a new threshold value V' to be compared with the absolute value of the difference |E−F| on the basis of the tonality t and the ratio of the tonality t to the tonality t', or t/t'. Thereafter, in Step S14, it modifies the scale factor so as to make the absolute value of the difference |E−F| not greater than the threshold value V'. It is possible to modify the scale factor by a number of steps that correspond to the difference between the absolute value of the difference |E−F| and the threshold value V', for example, if the scale factor is defined in such a way that the energy is changed by a predetermined amount (e.g., 2 dB) by raising or lowering the scale factor by a step in a plurality of steps predefined for the scale factor. In other cases, it is possible to make the absolute value of the difference |E−F| not greater than the threshold value V' by raising or lowering the scale factor by a step and calculating the energy each time. When defining the threshold value V', it is preferable to define the threshold value V' to be equal to the threshold value V and if the ratio t'/t is close to 1 because the spectral change seems to be small. On the other hand, it is preferable to define the threshold value V' so as to make it greater than the threshold value V and reduce the extent of adjustment if the ratio t'/t is too large or too small because the spectral change seems to be large. In this way, it is possible to establish a tradeoff between the extent of adjustment of the energy and the accuracy of encoding.

Figure 1:
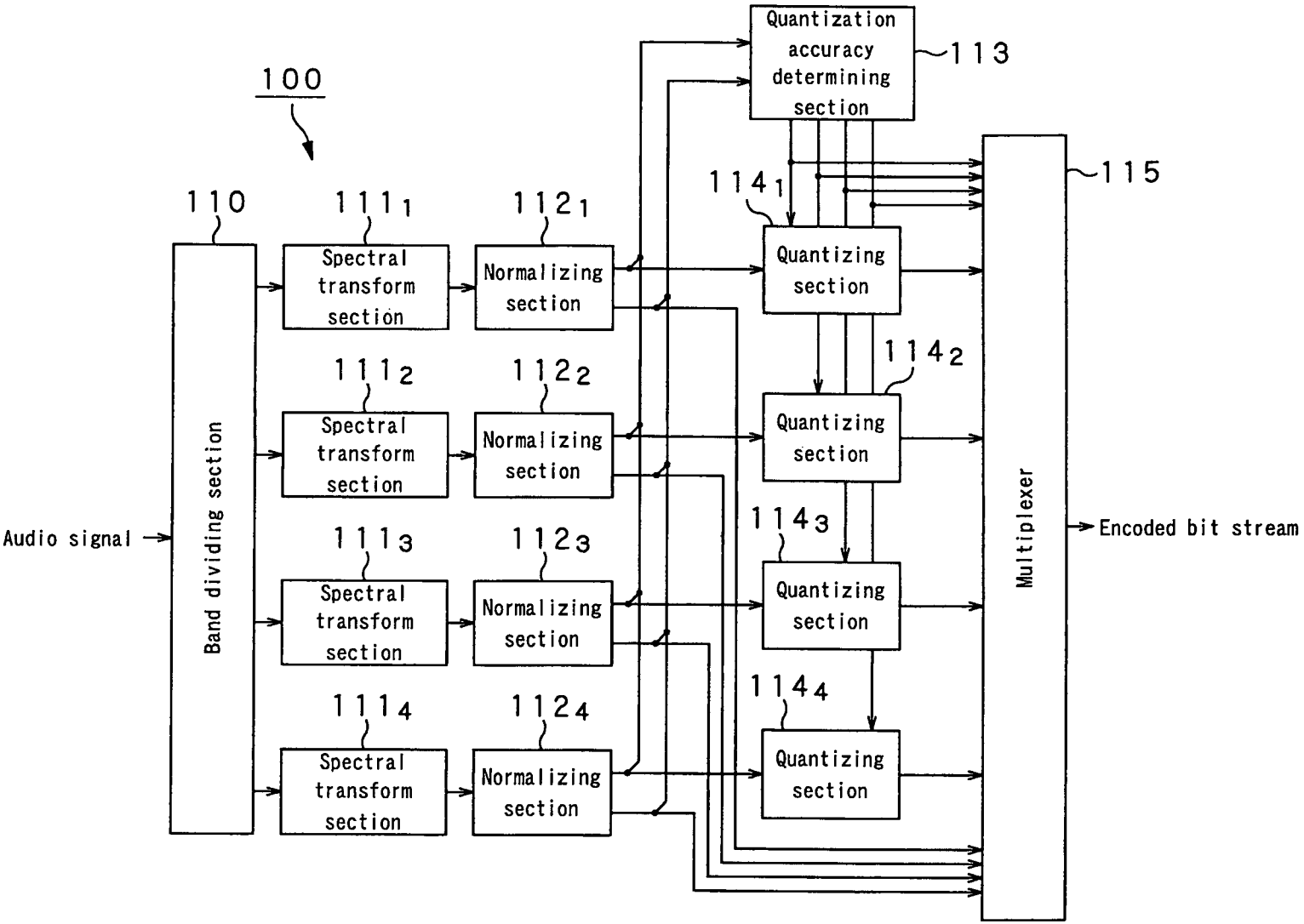
FIG. 1 is a schematic block diagram of a known audio signal encoding apparatus.
Figure 2:
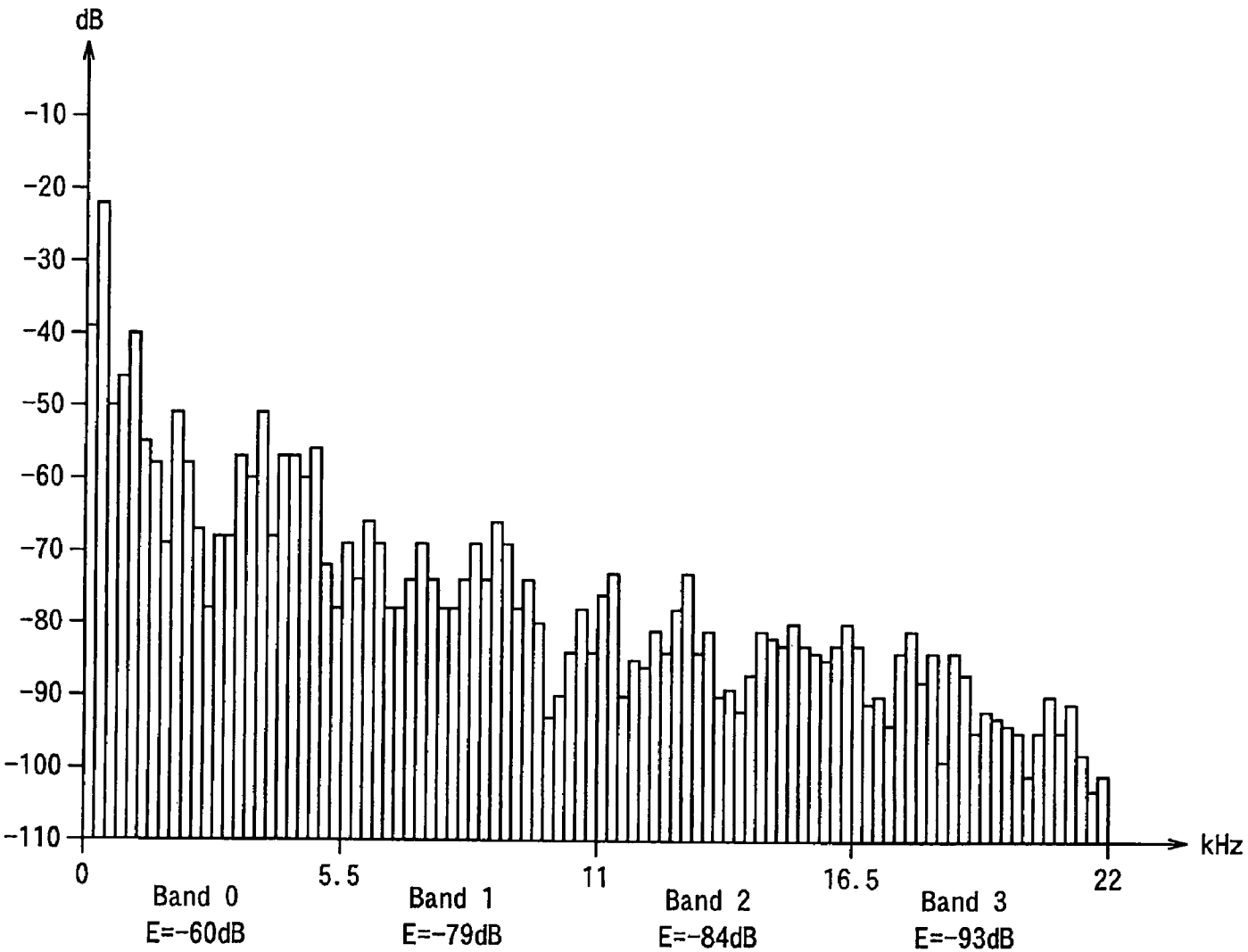
FIG. 2 shows a spectral signal obtained by dividing an audio signal with a frequency band width of 22 kHz into four audio signals of four sub-bands and conducting a spectral transmission of MDCT and the average energy E (dB) of the spectral coefficients of each sub-band.
Figure 3:
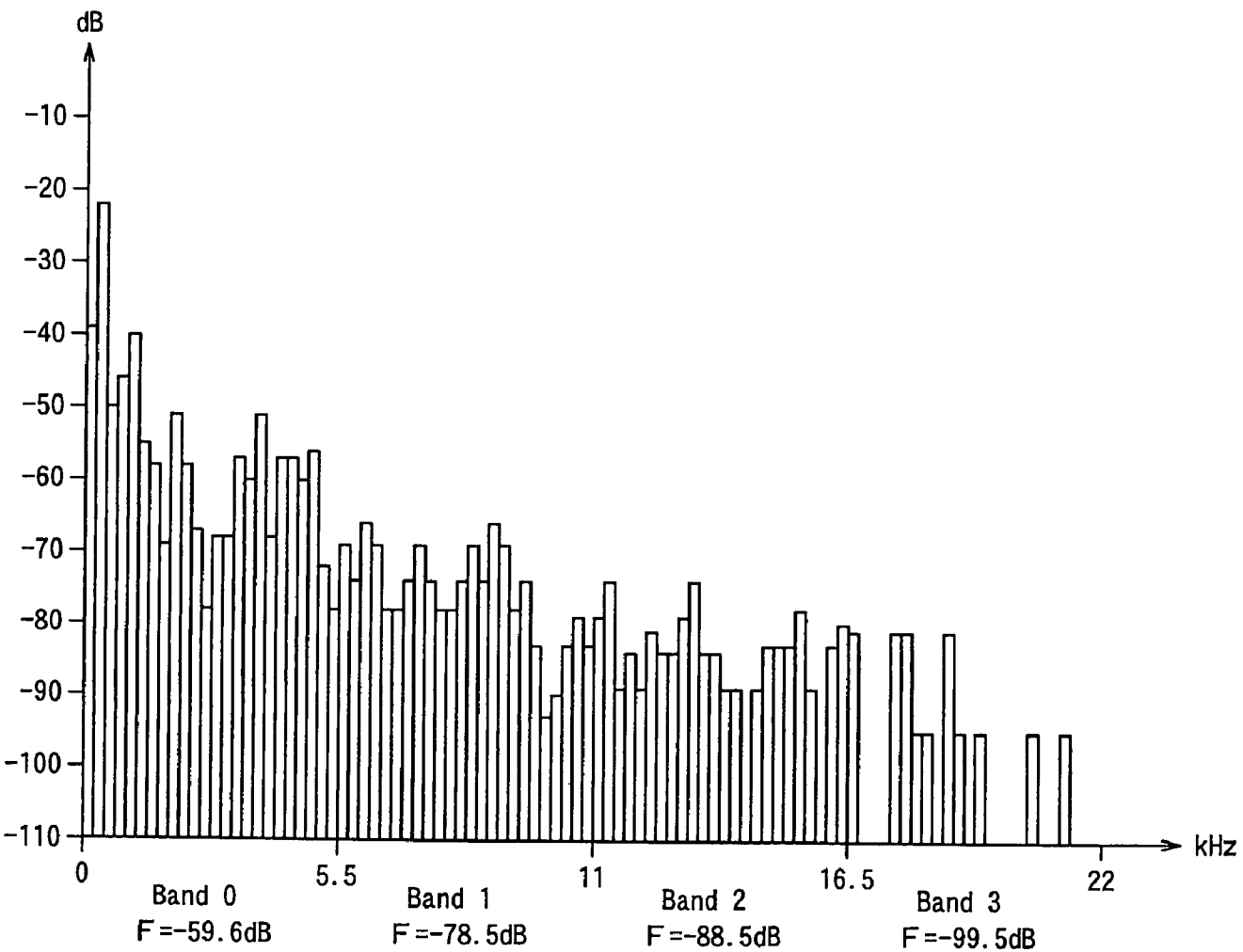
FIG. 3 shows a spectral signal obtained by decoding the encoded spectral signal of FIG. 2 and the average energy F (dB) of the spectral coefficients of each sub-band.
Figure 7:
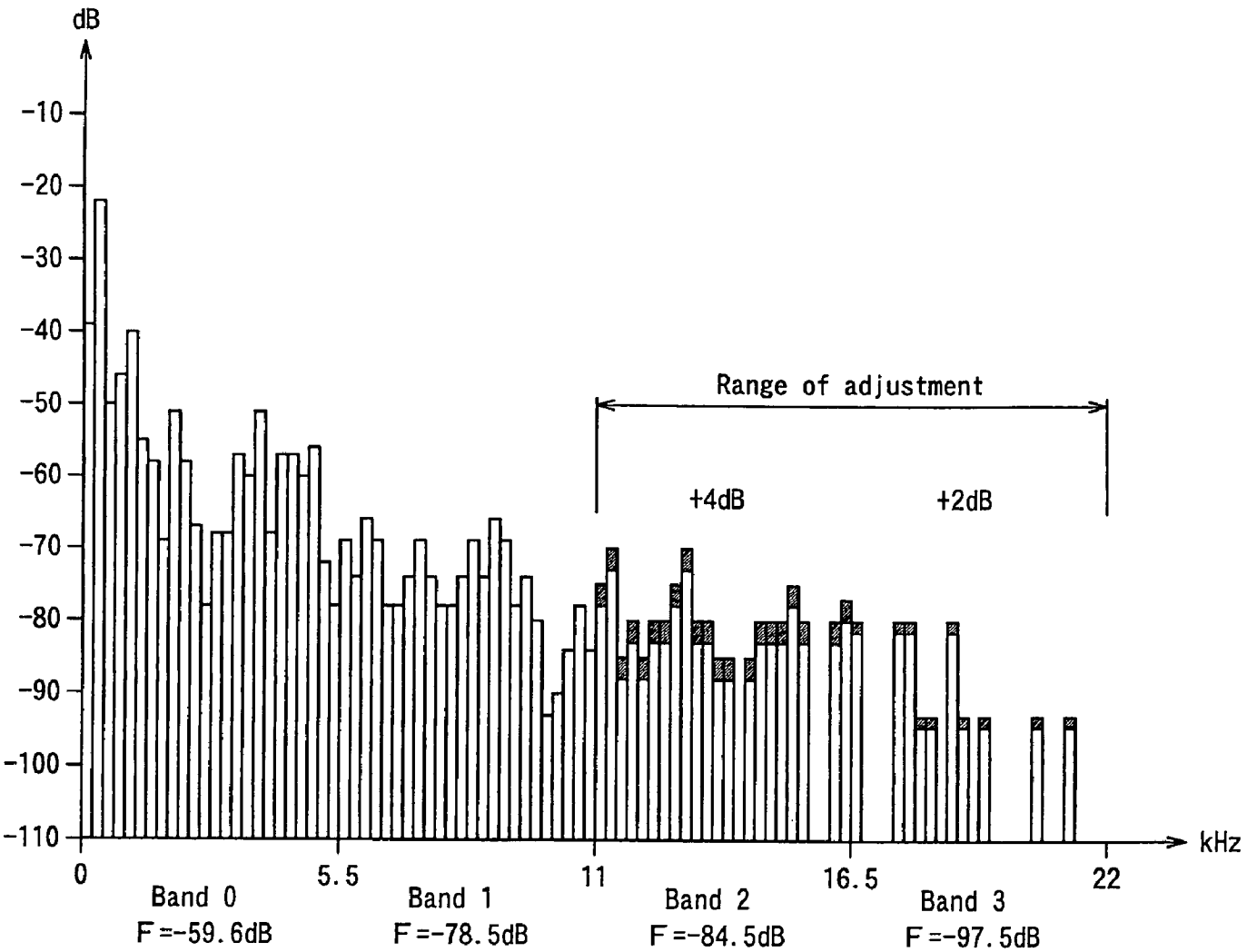
FIG. 7 shows a spectral signal obtained by adjusting the scale factor of the encoded spectral signal of FIG. 2 and decoding it and the average energy F (dB) of the spectral coefficients of each sub-bands.

FIG. 7 shows a spectral signal obtained by normalizing and quantizing the spectral signal of FIG. 2, encoding the scale factor of the spectral signal and decoding it and the average energy F (dB) of the spectral coefficients of each sub-bands. It will be seen from FIG. 7 that the average energy F of the spectral coefficient is increased by 4 dB and 2 dB respectively in sub-band 2 and in sub-band 3 to almost restore the original levels. If the energy changes by 2 dB as a result of raising or lowering the scale factor by a step, the above change corresponds to an adjustment of the scale factor by 2 steps in sub-band 2 and an adjustment of the scale factor by 1 step in sub-band 3.

As described above, the audio signal encoding apparatus 1 of this embodiment is adapted to compare the average energy of the spectral coefficients of each sub-band of a normalized spectral signal after normalization and before quantization with the average energy of the spectral coefficients of each sub-band of the quantized spectral signal obtained as a result of quantization and, if they do not agree with each other and the energy of a sub-band is reduced after quantization, adjust the scale factor of the sub-band to correct the disagreement of the two energies. As a result, it is possible to prevent any auditory problem from occurring when reproducing the audio signal.

The present invention is by no means limited to the above-described embodiment, which may be modified and altered in various different ways without departing from the spirit and scope of the present invention.

It should be understood by those skilled in the art that various modifications, combinations, sub-combinations and alterations may occur depending on design requirements and other factors insofar as they are within the scope of the appended claims or the equivalents thereof.

What is claimed is:

1. An audio signal encoding apparatus comprising:

a band dividing unit for dividing an input audio signal by a plurality frequency sub-bands;

a spectral transform unit for transforming the audio signal of each frequency sub-band into a spectral signal;

a normalizing unit for normalizing each spectral signal by means of a scale factor and generating a normalized spectral signal;

a quantizing unit for quantizing each normalized spectral signal and generating a quantized spectral signal;

a scale factor adjusting unit for adjusting the value of the scale factor used by the normalizing unit according to the normalized spectral signal and the quantized spectral signal; and an encoding unit for encoding at least each quantized spectral signal and the scale factor used by the normalizing unit or the scale factor adjusted by the scale factor adjusting unit, wherein, the scale factor adjusting unit is adapted to compare the absolute value of the difference of the energy of the normalized spectral signal and the energy of the quantized spectral signal with a first threshold value for each frequency sub-band and, if the absolute value of the difference is greater than the first threshold value, adjust the value of the scale factor used by the normalizing unit so as to make the absolute value of the difference of the energies not greater than a second threshold value.

2. The apparatus according to claim 1, wherein the scale factor adjusting unit adjusts the scale factor used by the normalizing unit only in the frequency sub-band or sub-bands above a predetermined frequency boundary.

3. The apparatus according to claim 1, wherein the scale factor adjusting unit decides if it adjusts the scale factor or not according to the tonality of the normalized spectral signal in each frequency sub-band or the tonality of the normalized spectral signal in each frequency sub-band and the tonality of the quantized spectral signal in each frequency sub-band.

4. The apparatus according to claim 1, wherein the scale factor adjusting unit defines the second threshold value according to the tonality of the normalized spectral signal in each frequency sub-band and the tonality of the quantized spectral signal in each frequency sub-band.

5. An audio signal encoding method comprising:

a band dividing step of dividing an input audio signal by a plurality frequency sub-bands;

a spectral transform step of transforming the audio signal of each frequency sub-band into a spectral signal;

a normalizing step of normalizing each spectral signal by means of a scale factor and generating a normalized spectral signal;

a quantizing step of quantizing each normalized spectral signal and generating a quantized spectral signal;

a scale factor adjusting step of adjusting the value of the scale factor used in the normalizing step according to the normalized spectral signal and the quantized spectral signal; and an encoding step of encoding at least each quantized spectral signal and the scale factor used in the normalizing step or the scale factor adjusted in the scale factor adjusting step, wherein, the scale factor adjusting step is adapted to compare the absolute value of the difference of the energy of the normalized spectral signal and the energy of the quantized spectral signal with a first threshold value for each frequency sub-band and, if the absolute value of the difference is greater than the first threshold value, adjust the value of the scale factor used by the normalizing step so as to make the absolute value of the difference of the energies not greater than a second threshold value.

6. The method according to claim 5, wherein the scale factor adjusting step is adapted to adjust the scale factor used in the normalizing step only in the frequency sub-band or sub-bands above a predetermined frequency boundary.

7. The method according to claim 5, wherein the scale factor adjusting step is adapted to decide if the scale factor is adjusted in the step or not according to the tonality of the normalized spectral signal in each frequency sub-band or the tonality of the normalized spectral signal in each frequency sub-band and the tonality of the quantized spectral signal in each frequency sub-band.

8. The method according to claim 5, wherein the scale factor adjusting step is adapted to define the second threshold value according to the tonality of the normalized spectral signal in each frequency sub-band and the tonality of the quantized spectral signal in each frequency sub-band.

9. An audio signal encoding apparatus comprising:

a band dividing section that divides an input audio signal by a plurality frequency sub-bands;

a spectral transform section that transforms the audio signal of each frequency sub-band into a spectral signal;

a normalizing section that normalizes each spectral signal by means of a scale factor and generates a normalized spectral signal;

a quantizing section that quantizes each normalized spectral signal and generates a quantized spectral signal;

a scale factor adjusting section that adjusts the value of the scale factor used by the normalizing section according to the normalized spectral signal and the quantized spectral signal; and an encoding section that encodes at least each quantized spectral signal and the scale factor used by the normalizing section or the scale factor adjusted by the scale factor adjusting section wherein, the scale factor adjusting section is adapted to compare the absolute value of the difference of the energy of the normalized spectral signal and the energy of the quantized spectral signal with a first threshold value for each frequency sub-band and, if the absolute value of the difference is greater than the first threshold value, adjust the value of the scale factor used by the normalizing section so as to make the absolute value of the difference of the energies not greater than a second threshold value.

* * * * *